US007695411B2

(12) United States Patent
Pandozy

(10) Patent No.: US 7,695,411 B2
(45) Date of Patent: Apr. 13, 2010

(54) MULTIMOTION EXERCISE APPARATUS AND METHOD

(76) Inventor: Raffaele Martini Pandozy, 2312 Grand Ave., Apt. A, Dallas, TX (US) 75215

( * ) Notice: Subject to any disclaimer, the term of this patent is extended or adjusted under 35 U.S.C. 154(b) by 38 days.

(21) Appl. No.: 12/221,694

(22) Filed: Aug. 6, 2008

(65) Prior Publication Data

US 2010/0035729 A1 Feb. 11, 2010

(51) Int. Cl.
*A63B 22/12* (2006.01)

(52) U.S. Cl. ..... 482/62; 482/96

(58) Field of Classification Search ..... 482/51, 482/57, 58, 59, 62, 63, 64, 65, 72, 93, 94, 482/95, 96, 133; 472/106, 110, 120
See application file for complete search history.

(56) References Cited

U.S. PATENT DOCUMENTS 2,675,236 A * 4/1954 Blickman ..... 482/62
4,300,760 A * 11/1981 Bobroff ..... 482/96
5,356,357 A * 10/1994 Wang et al. ..... 482/96
5,405,305 A * 4/1995 Wilkinson et al. ..... 482/51
5,580,339 A * 12/1996 Chen ..... 482/95
6,120,419 A * 9/2000 Huang ..... 482/96
7,097,598 B2 * 8/2006 Lee ..... 482/57
7,452,311 B2 * 11/2008 Barnes et al. ..... 482/96
2007/0161467 A1 * 7/2007 Lee ..... 482/57

* cited by examiner

*Primary Examiner*—Loan H Thanh
*Assistant Examiner*—Tam Nguyen
(74) *Attorney, Agent, or Firm*—Schultz & Associates, P.C.

(57) ABSTRACT

A multimotion exercise bicycle capable of providing a cardiovascular exercise simultaneously with an upper body weight training exercise. The cardiovascular exercise is accomplished by a pedaling movement connected to a resistance means. The upper body exercise is accomplished by a pushing or a pulling movement of a handlebar and arm setup connected to a disk which is further connected to a cable attached to a weight bearing platform. The weight of the user provides the resistance for the upper body movement. The difficulty level of the upper body movement is adjustable by changing the location of the handlebars relative to the disk and by changing where the cable attaches to the disk. As the user performs these exercises simultaneously, the invention allows the user to burn more calories and reduce work-out time in half.

13 Claims, 8 Drawing Sheets

MULTIMOTION EXERCISE APPARATUS AND METHOD

FIELD OF THE INVENTION

The present invention relates to the field of exercise equipment. In particular, the invention relates to a stationary bicycle having handlebars connected to a weight bearing platform via a pulley system which allows the user to exercise the upper body by lifting the user's body weight while simultaneously exercising the lower body by pedaling the stationary bicycle.

BACKGROUND OF THE INVENTION

Individuals exercising on a regular basis in order to keep physically fit is an increasing trend. Studies on physical fitness have shown that weight training coupled with a cardiovascular exercise give an individual the best opportunity to achieve the desired physically fit body. The weight training should involve both pushing movements and pulling movements with sufficient resting time in between movements. Cardiovascular or aerobic exercises help to condition and strengthen muscles while stimulating the capillaries in the muscles helping oxygen and nutrients to be more easily delivered to the muscles. A consistent program of cardiovascular exercise also enhances blood circulation enabling strained muscles to heal more quickly. The amount of cardiovascular exercise required to see results ranges from 20 to 45 minutes a day, four to five days a week. Often an individual's fitness goals are cut short by time constraints. An individual's busy schedule often makes it difficult to find the proper amount of time to devote to a balanced combination of weight training and cardiovascular exercise.

The prior art is replete with exercise equipment suitable for weight training and additional equipment suitable for cardiovascular exercise. The weight training equipment has many forms from simple benches and free weights to complicated universal weight machines to resistance machines taking advantage of the elastic nature of different sizes of bars or bows. Because of the required additional weights or bars needs to perform the exercise, the weight training machines known in the art can be bulky, difficult to transport, and take up a lot of precious floor space whether in a commercial gym or at home.

The equipment available for cardiovascular exercise is also numerous including stationary bicycles, treadmills, elliptical machines, and stair stepping machines. None of the prior art suitable for cardiovascular or aerobic exercise includes a weight training feature for the upper body. Using the equipment known in the art, any movement by the upper body is driven by the momentum created from and is mechanically linked to the pedaling, running, or stepping movement of the lower body.

Therefore a need exists for exercise equipment that saves time, maximizes an individual's fitness routine, and minimizes the floor space required while combining a cardiovascular exercise simultaneously with a true weight training exercise using the individual's own body weight for resistance.

SUMMARY OF INVENTION

The present invention addresses the need for exercise equipment to combine an upper body workout with a cardiovascular exercise and lower body workout. The present invention shortens total exercise time for an individual by providing an apparatus and method where a cardiovascular exercise and a weight training exercise can be performed simultaneously. Intended both for gym and home use, the apparatus is especially designed for individuals who desire to spend less total time exercising. The apparatus offers a combination of multiple upper body movements as performed on typical weight machines with the cardiovascular exercise of stationary exercise bikes. As the user performs the upper body movements simultaneously with the pedaling of the stationary bike, the apparatus allows the user to burn more calories and reduce work-out time by half. As the resistance is provided by the user's own body weight, the actual apparatus is light, compact and easily transported.

The primary components of the apparatus include a stationary bicycle portion adjustably secured to a weight bearing platform pivotally connected to a pair of vertical supports, a rectangular base frame, a handlebar and arm setup adjustably attached to a disk, and a pulley system connecting the disk to the weight bearing platform. Accordingly, an embodiment of the present invention provides a multimotion exercise bicycle capable of providing an upper body workout simultaneously with a cardiovascular exercise. The stationary bicycle portion of the apparatus includes a seat and pedals connected to a resistance means and sits on a platform. The position of the stationary bicycle portion can be adjusted longitudinally along the length of the platform to accommodate various sizes of users and position a user for different upper body movements. The platform is pivotally attached at one end to a pair of vertical supports which are securely affixed to a base frame. The opposite end of the platform rests on the base frame. The platform is further connected by a cable to a disk. The cable is permanently secured to the platform and removably secured to the disk. The length of the cable can be adjusted so that the cable is always taut between the platform and the disk. The disk is adjustably connected to a handlebar and arm setup. The handlebars and arm are adjustable to different positions on the disk to accommodate different height users and performing different upper body movements. Six upper body movements are targeted by the apparatus. The six upper body movements include a shoulder press, a lat pulldown, a dip, a shoulder shrug, a biceps curl, and a triceps extension.

To perform simultaneous exercises, a user sits on the stationary bicycle portion of the apparatus and begins pedaling. While pedaling, a user pushes or pulls the handlebars. The handlebars rotate the disk and pull on the cable. The cable passes through a pair of pulley wheels and lifts the platform supporting the user. The weight of the user provides the resistance for the upper body movements. The difficulty level of the upper body movements can be adjusted by adjusting the connection point of the cable to the disk and by adjusting the starting position of the handlebars.

An alternate embodiment of the apparatus adds additional weight to the platform. An additional alternate embodiment provides an electrical control to program workouts that vary pedaling resistance. The control includes a monitor to display feedback on program level, duration, distance, RPM, speed, heart rate, calories burned and average speed.

Those skilled in the art will appreciate the above-mentioned features and advantages of the invention together with other important aspects thereof upon reading the detailed description that follows in conjunction with the drawings provided.

BRIEF DESCRIPTION OF THE DRAWINGS

In the detailed description of the preferred embodiments presented below, reference is made to the accompanying drawings.

DETAILED DESCRIPTION OF THE PREFERRED EMBODIMENT

Figure 1:
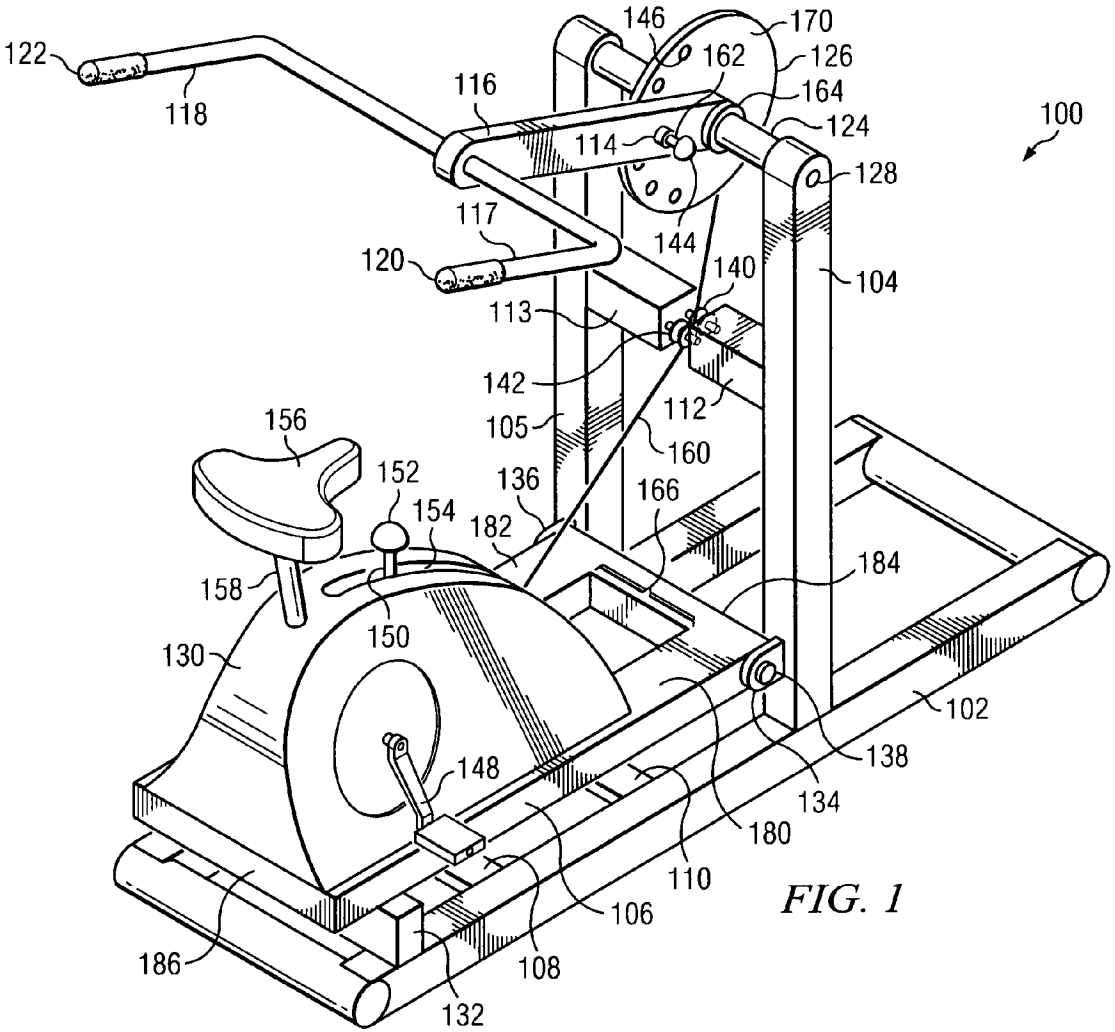
FIG. 1 is an isometric view of a preferred embodiment of the present invention.

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

Figure 2:
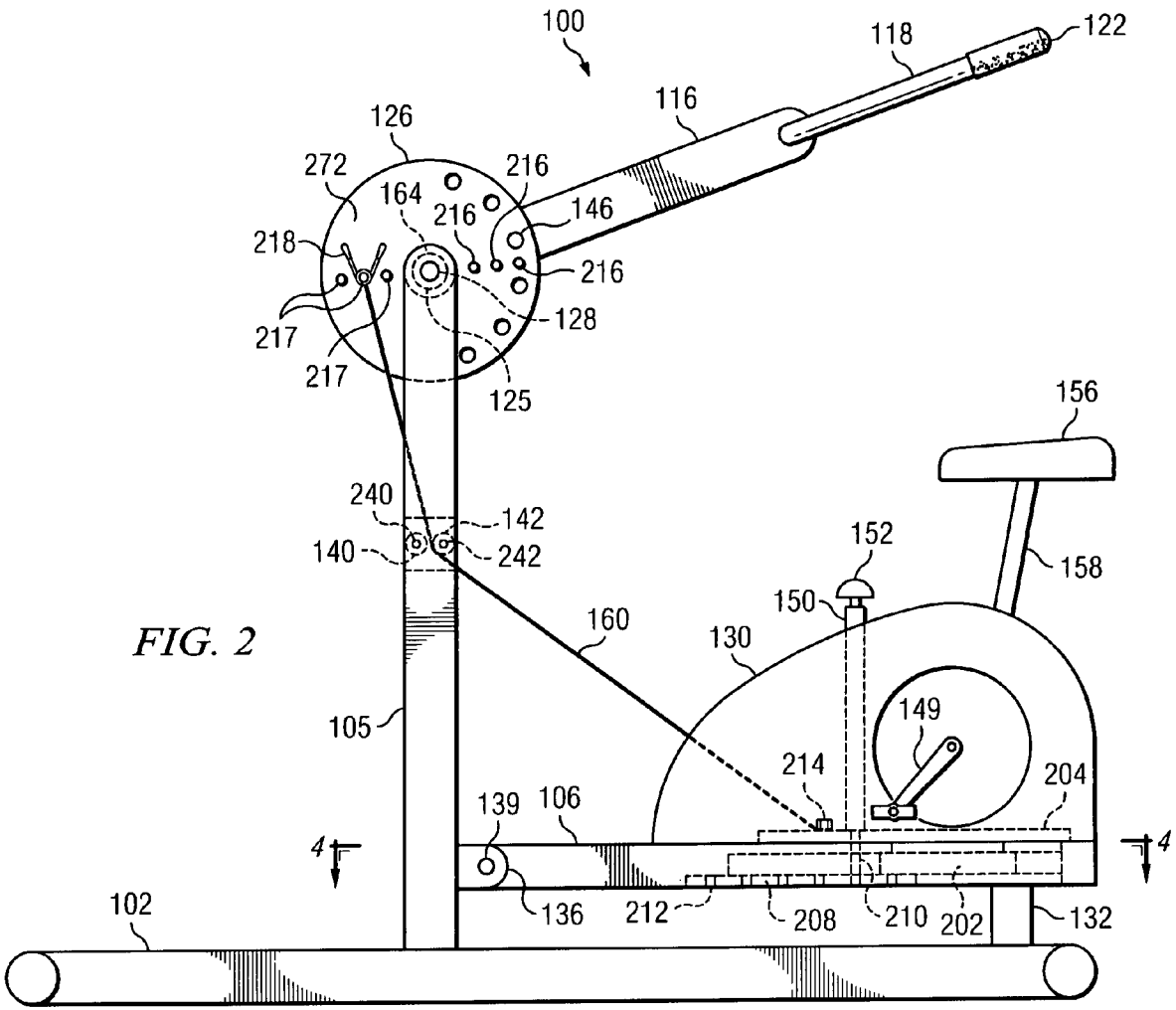
FIG. 2 is an elevation view of a preferred embodiment of the present invention.
Figure 3:
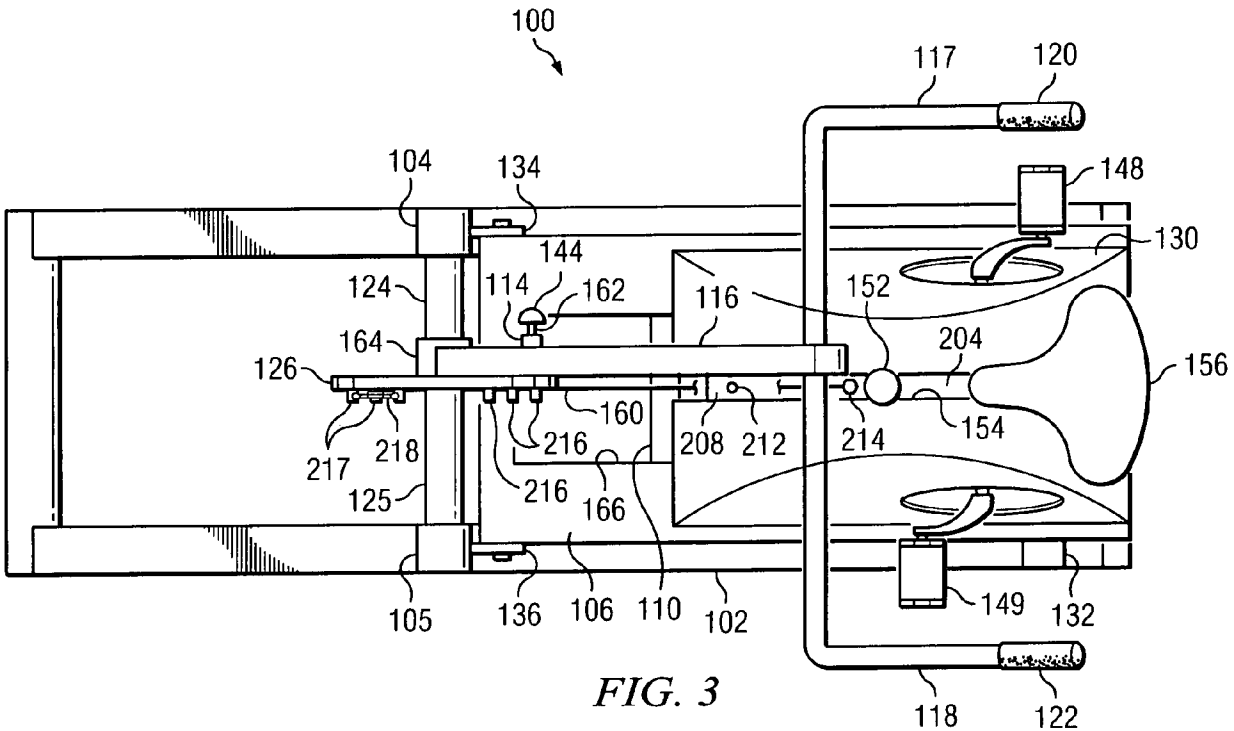
FIG. 3 is a plan view of a preferred embodiment of the present invention.

Exercise apparatus 100 is shown in FIGS. 1-3. Base 102 is a rectangular shaped support structure comprised of 2 inch square hollow steel or aluminum along its major sides and 2 inch circular hollow steel or aluminum along its minor sides. The major sides of base 102 can range from 5 to 6 feet in length and the minor sides of base 102 can range from 20 to 24 inches in length. Forming right angles and connected to the two major sides of platform 106 are braces 108 and 110. Connected to each major side of base 102 and extending perpendicularly for approximately four feet are uprights 104 and 105. Uprights 104 and 105 are 2 inch square hollow steel or aluminum. At the approximate midpoint of upright 104, crossbar 112 extends perpendicularly towards upright 105. At the approximate midpoint of upright 105 and aligned with crossbar 112, crossbar 113 extends perpendicularly towards upright 104. Connected between crossbars 112 and 113 are axles 240 and 242. Axles 240 and 242 are ¼ inch diameter steel rods and provide rotational axes for pulley wheels 140 and 142 respectively. Pulley wheels 140 and 142 are 1 inch diameter wheels with grooved rims. Pulley wheels 140 and 142 are positioned such that their center axes are parallel to each other, parallel to crossbars 112 and 113 and are at equal heights.

Spindle 128 is a ½ inch steel rod rigidly connecting uprights 104 and 105. Spindle 128 provides a rotational axis for sleeves 124 and 125 and disk 126. Sleeves 124 and 125 are 1½ inch diameter hollow steel or aluminum cylinders with ½ inch diameter holes through their lengthwise centerlines. Sleeve 124 is integrally formed with disk 126 at arm face 170 and sleeve 125 is integrally formed with disk 126 at cable face 272. Sleeves 124 and 125 extend perpendicularly from opposite sides of disk 126. The length of sleeve 124 is shorter than the length of sleeve 125 by the thickness of disk 126.

Adjacent to disk 126 at arm face 170 is arm 116. Arm 116 is 2 inch square hollow steel or aluminum and is approximately 30 inches in length. Arm 116 includes arm collar 164. Arm collar 164 defines a 1½ inch diameter hole through arm 116 that sleeve 124 passes through. Arm 116 includes stanchion 114. Stanchion 114 provides support for arm pin 162. Knob 144 is a molded plastic or hard rubber handle attached to arm pin 162. Arm pin 162 is a solid steel or aluminum rod approximately ½ inch in diameter. Arm pin 162 and knob 144 function as a spring loaded pin as is well known in the art which is biased towards and through arm 116 into one of a plurality of holes 146 in disk 126. In an alternate embodiment, arm pin 162 is held in one of a plurality of holes 146 by gravity and friction. Handlebars 117 and 118 are rigidly connected to arm 116. Handlebars 117 and 118 are L-shaped 1 inch hollow steel or aluminum tubes. Handlebars 117 and 118 extend perpendicularly from opposite sides of arm 116. In the preferred embodiment, handlebars 117 and 118 are a fixed length. In an alternate embodiment, the length of handlebars 117 and 118 is adjustable. At the ends of handlebars 117 and 118 are grips 120 and 122 respectively. In an alternate embodiment, an additional grip extends laterally at a ninety degree angle from the base of each grip 120 and 122 providing an alternate hand position. In the preferred embodiment, the grips are foam rubber hollow cylinders slipped over the ends of the handlebars. In alternate embodiments, the grips are made of plastic slipped over the ends of the handlebars. In additional alternate embodiments, the grips are grooves stippled in a criss-cross pattern directly into the handlebars.

Platform 106 is a rectangular shaped frame comprised of two major sides 180 and 182 and two minor sides 184 and 186. Platform minor sides 184 and 186 are constructed of 1½ inch square hollow steel or aluminum and in the preferred embodiment are approximately 18 to 19 inches in length. Platform major sides 180 and 182 are constructed of hollow steel or aluminum with approximate dimensions of 1½ inches by 5 inches by 40 inches. The space between platform major sides 180 and 182 is interspace 166 and in the preferred embodiment is approximately 8 to 9 inches wide.

Platform 106 is rotationally connected to uprights 104 and 105 by hinges 134 and 136 respectively. Pin 138 connects hinge 134 to platform 106 and provides a rotational axis. Pin 139 connects hinge 136 to platform 106 and provides a rotational axis. Platform 106 is supported by block 132. Block 132 is connected to base 102 and extends from one major side of base 102 to the other major side of base 102.

Figure 4:
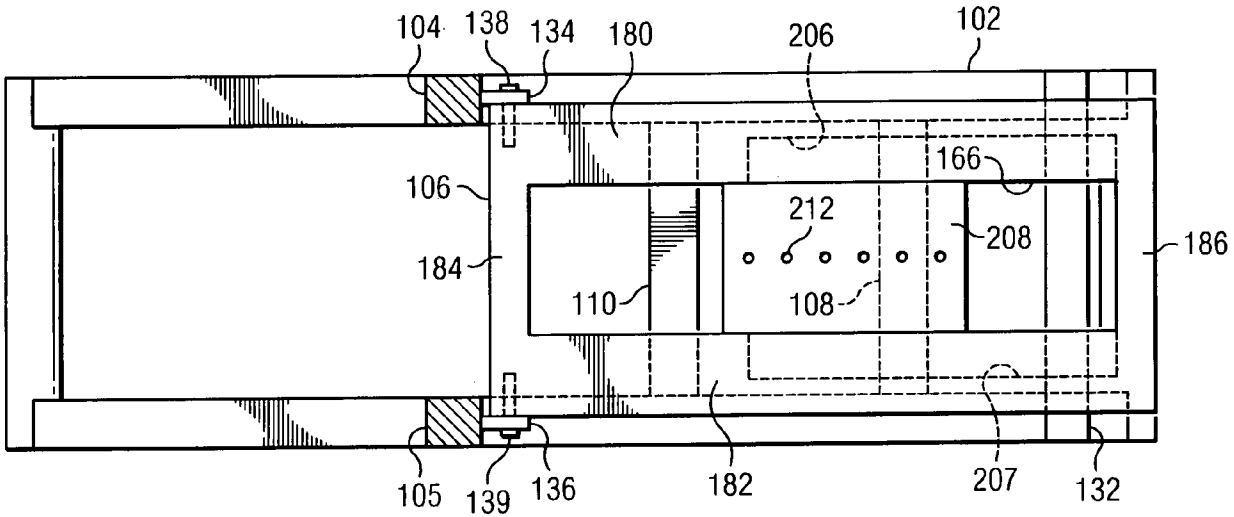
FIG. 4 is a plan view of a preferred embodiment of the present invention taken along line 4-4 of FIG. 2.
Figure 5:
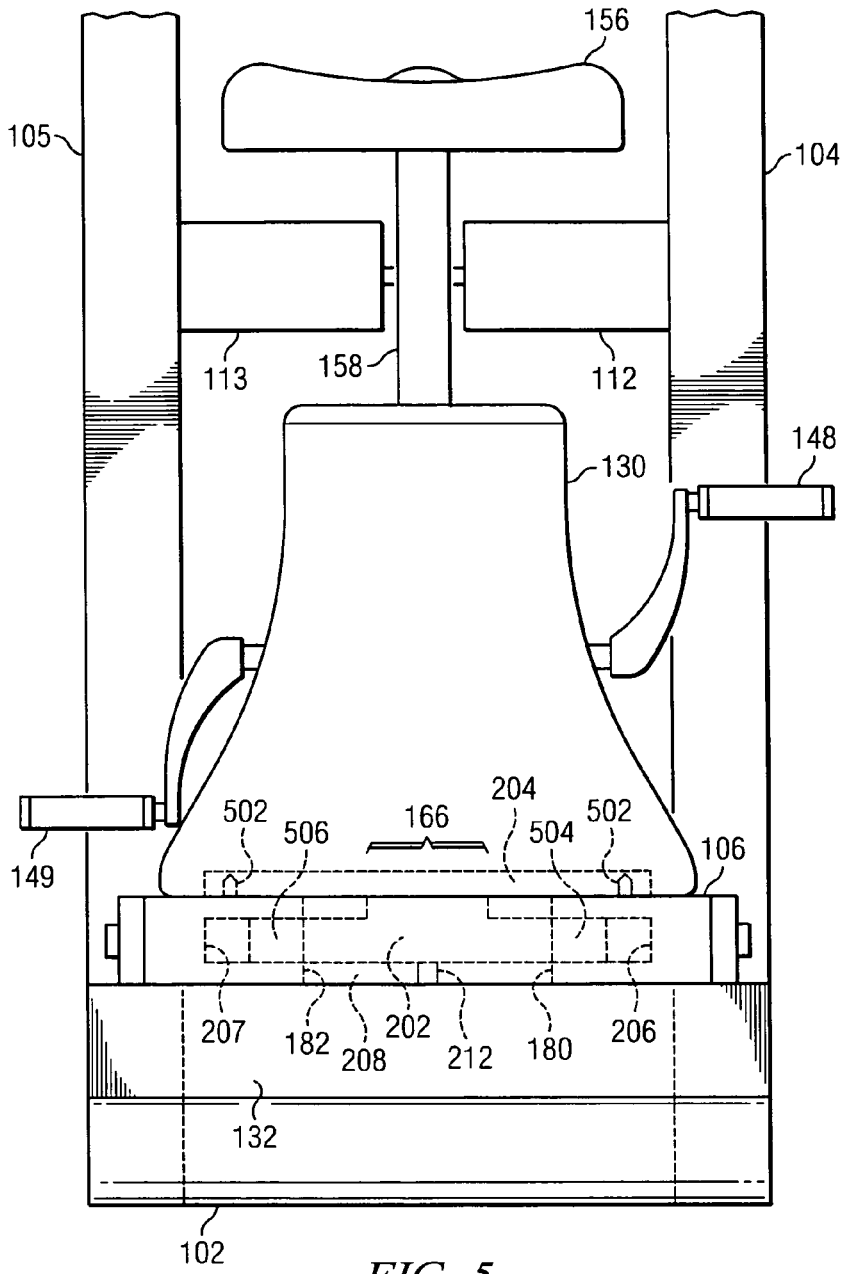
FIG. 5 is a partial elevation view from the rear of a preferred embodiment of the present invention.
Figure 6:
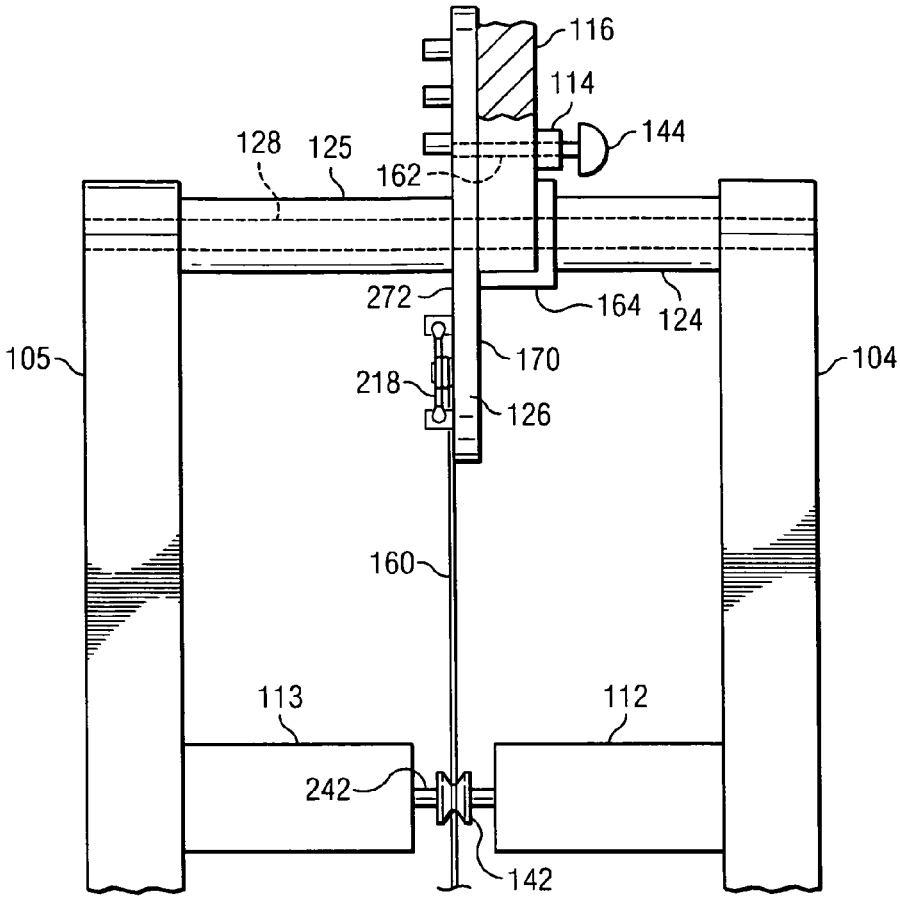
FIG. 6 is partial elevation view of the vertical support structure including the disk of a preferred embodiment of the present invention.

As shown in FIGS. 4 and 5, the interior lateral surface of platform major side 180 includes slot 206. The interior lateral surface of platform major side 182 includes slot 207. Slots 206 and 207 are both three sided rectangular shaped indentures with an approximate height of ½ inch and depth of 2½ to 3 inches. Slots 206 and 207 have an approximate length of 20 to 24 inches. Slots 206 and 207 begin at the approximate midpoint of the length of platform major sides 180 and 182 and continue towards platform minor side 186. Platform 106 also includes position plate 208. Position plate 208 is a solid steel or aluminum plate that is connected to both interior lateral surfaces of platform major sides 180 and 182 spanning interspace 166. The bottom surface of position plate 208 is flush with the bottom surface of platform 206. Position plate 208 includes a plurality of plate holes 212 aligned down its centerline. Plate holes 212 are approximately ½ inch in diameter and pass completely through position plate 208.

As shown in FIGS. 1, 2 and 5, platform 106 supports housing 130. Housing 130 is formed out of plastic or equivalent material with similar weight and strength characteristics. Pedals 148 and 149 extend from opposite sides of housing 130. Connected to pedals 148 and 149 in the interior of housing 130 is a resistance means as is common in the art for stationary exercise bicycles. Gap 154 bisects one half of housing 130. Shaft 150 passes through gap 154 of housing 130 and is connected to housing plate 204. Shaft 150 provides support for position pin 210. Knob 142 is a molded plastic or hard rubber handle attached to position pin 210. Position pin 210 is a solid steel or aluminum rod approximately ½ inch in diameter. Position pin 210 and knob 152 comprise a spring loaded pin as is well known in the art which is biased towards housing plate 204. Housing plate 204 is a solid steel or aluminum plate approximately ½ inch thick. Housing plate 204 is connected to housing 130 by a number of machine screws 502. Housing plate 204 is integrally formed with or welded to sled 202. Sled 202 is solid steel or aluminum plate approximately 12 inches in length with an inverted T-shaped cross section. Sled 202 includes sled flanges 504 and 506 that extend parallel to housing plate 204. The overall width of sled 202 is wider than interspace 166. Housing plate 204 includes an attachment point for cable 160. In the preferred embodiment, bolt 214 adjustably affixes cable 160 to housing plate 204 at the base of shaft 150. Bolt 214 can be loosened to adjust the length of cable 160 to allow for different heights of different users. In an alternate embodiment, a spring biased knob adjustably attaches cable 160 to housing plate 204. Saddle post 158 extends vertically from housing 130 and is attached to saddle 156.

As is shown in FIGS. 1-3 and 6, cable 160 is attached to housing plate 204, extends through gap 154, passes between pulley wheels 140 and 142 and a looped end is removably secured to disk 126 by spring collar 218 on one of a series of cable hubs 216 or 217. In alternate embodiments, a nut, rubber or plastic cap, or clamp may be used to removably secure cable 160 to a cable hub. In the preferred embodiment, cable 160 is ¼ inch plastic sheathed wire rope with a tensile strength ranging from 5,000 to 10,000 PSI. In alternate embodiments, cable 160 is a rubber or leather belt. In additional alternate embodiments, cable 160 is a stainless steel metal tape having a width of approximately 1½ inches.

Figure 7:
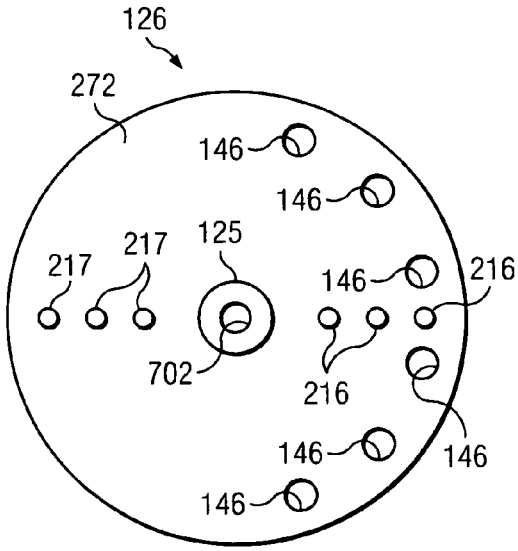
FIG. 7 is an elevation view of the disk of a preferred embodiment of the present invention.
Figure 8:
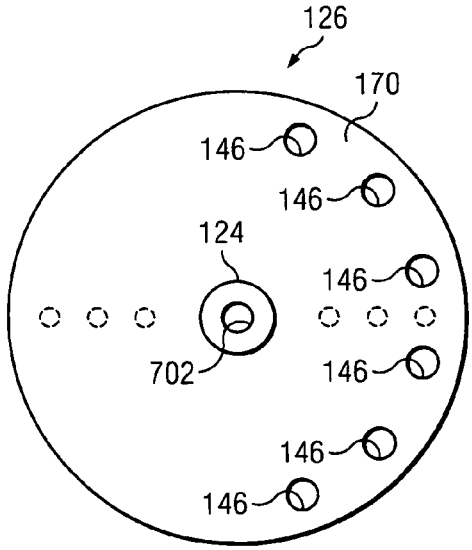
FIG. 8 is an elevation view of the disk of a preferred embodiment of the present invention.

FIGS. 7 and 8 show disk 126. Disk 126 is a flat circular disk shaped member made of steel or aluminum approximately fourteen inches in diameter and approximately ½ inch thick. The lateral surface shown in FIG. 7 is cable face 272. In the preferred embodiment, cable face 272 of disk 126 includes 3 aligned cable hubs 216 and 3 aligned cable hubs 217 extending perpendicular from cable face 272. Cable hubs 216 are situated linearly and are located on the opposite side of disk hole 702 from the linearly situated cable hubs 217. Cable hubs 216 and 217 are 1 to 2 inch long solid steel or aluminum posts approximately ¼ inch in diameter. Disk 126 also includes a plurality of holes 146. In the preferred embodiment, disk 126 has six circular holes 146 located near the perimeter of disk 126 that pass through the entire thickness of disk 126. Cable face 272 of disk 126 also includes the integrally formed or welded sleeve 125. Sleeve 125 is a hollow cylinder extending perpendicular from cable face 272. The middle of disk 126 defines disk hole 702. Disk hole 702 is approximately ½ inch in diameter and is concentrically aligned with the hollow middle of sleeves 124 and 125.

The lateral surface shown in FIG. 8 is arm face 170. Arm face 170 includes the same holes 146. Arm face 170 of disk 126 also includes the integrally formed or welded sleeve 124 extending perpendicular from arm face 170.

During operation, exercise apparatus 100 leverages a user's own body weight to provide resistance for an upper body workout. A user of exercise apparatus 100 can perform the upper body exercises simultaneously with the cardiovascular exercise of riding a stationary bicycle. The overall time of a workout is reduced as two exercises can be performed at the same time. Additionally a user of exercise apparatus 100 can burn more calories in a shorter timeframe than the typical stationary bike rider or the weight machine user individually.

To perform simultaneous exercises using exercise apparatus 100, a user must adjust the position of housing 130 relative to platform 106, adjust the position of arm 116 relative to disk 126, and adjust the attachment point of cable 160 to disk 126.

To adjust the position of housing 130 relative to platform 106, knob 152 and the attached position pin 210 is pulled upward approximately 1 inch until position pin 210 clears position plate 208. Position pin 210 which had been seated in a plate hole 212 is released from position plate 208 when pulled upward. After position pin 210 is released from position plate 208, housing 130 is free to slide longitudinally along platform 106 towards and away from platform minor sides 184 and 186. Sled flanges 504 and 506 of sled 202 slide in slots 206 and 207 respectively. When the desired longitudinal position of housing 130 is reached, knob 152 is released and position pin 210 passes through an appropriately aligned plate hole 212. In the preferred embodiment, position pin 210 is spring biased. In an alternate embodiment, gravity and friction hold position pin 210 seated in place.

To adjust the position of arm 116 relative to disk 126, knob 144 and the attached arm pin 162 are pulled away from arm 116 and disk 126 approximately 1 inch until arm pin 162 clears disk 126. The spring biased arm pin 162 is removed from disk 126. Arm 116 is now free to rotate around sleeve 124 via arm collar 164. Arm 116 is rotated into the desired position and arm pin 162 is aligned with a corresponding hole 146. Knob 144 and arm pin 162 are released. Arm pin 162 passes through hole 146 of disk 126 preventing arm 116 from freely rotating relative to sleeve 124 and disk 126. Each hole 146 represents a different position for arm 116. Each different position of arm 116 represents a different upper body exercise or difficulty level. A user adjusts arm 116 to a position where the user may perform one of six upper body movements. In the upper most position or the lower most position, the range of motion is maximized and the difficulty level is increased. The intermediate positions allow shorter ranges of motion, thus making each movement less difficult. Differing heights of users may alter this typical configuration.

To adjust the attachment point of cable 160 to disk 126, spring collar 218 is removed. A looped end of cable 160 is removed from around a cable hub 216 or 217 and moved to a different cable hub. Spring collar 218 is then secured to the cable hub to prevent cable 160 from detaching from the cable hub. The desired upper body exercise dictates the attachment position of cable 160 to disk 126. For the shoulder press, the shoulder shrug, and the biceps curl, cable 160 is attached to one of three cable hubs 216 and arm 116 will move upwardly. For the lat pulldown, the dip, and the triceps extension, cable 160 is attached to one of three cable hubs 217 and arm 116 will move downwardly. The difficulty level of the movement also dictates the attachment position of cable 160 to disk 126. The outer most cable hub of each set of cable hubs 216 and 217 provides the most strenuous difficulty level. As the attachment point is moved closer to the center of disk 126, the force necessary to move arm 116 and thus rotate disk 126 lessens.

To perform a shoulder press movement while simultaneously performing cardiovascular exercise, housing 130 is adjusted to be directly under grips 120 and 122 and cable 160 is attached to one of three cable hubs 216. Arm 116 is adjusted relative to disk 126 so that arm 116 is approximately shoulder level. The length of cable 160 is adjusted to remove any slack by loosening bolt 214, pulling cable 160 taut, and retightening bolt 214. The user sits on saddle 156 and places the feet on pedals 148 and 149. As the user begins pedaling, the user simultaneously uses the hands to grab grips 120 and 122 and push up on handlebars 117 and 118. The upward force on handlebars 117 and 118 causes arm 116 to raise which in turn causes disk 126 to rotate away from the user. Cable hub 216 pulls on cable 160 which after passing around pulley wheels 140 and 142 pulls on housing plate 204. As housing plate 204 is pulled upward housing plate 204 pulls the attached sled 202 upward. Sled flanges 504 and 506 as a result of being seated in slots 206 and 207 respectively force platform 106 upward. Platform 106 rotates about hinges 134 and 136 until the user fully extends the arms above the head and stops pushing on handlebars 117 and 118. The user slowly returns the arms to the starting position and begins the movement again. The user's own weight provides the resistance for the movement.

To perform a shoulder shrug movement while simultaneously performing cardiovascular exercise, housing 130 is adjusted to be directly under grips 120 and 122 and cable 160 is attached to one of three cable hubs 216. Arm 116 is adjusted relative to disk 126 so that arm 116 is approximately waist level. The length of cable 160 is adjusted to remove any slack by loosening bolt 214, pulling cable 160 taut, and retightening bolt 214. The user sits on saddle 156 and places the feet on pedals 148 and 149. As the user begins pedaling, the user simultaneously uses the hands to grab grips 120 and 122 and raise the shoulders and handlebars 117 and 118 as high as possible while not bending the elbows. The upward force on handlebars 117 and 118 causes arm 116 to raise which in turn causes disk 126 to rotate away from the user. Cable hub 216 pulls on cable 160 which after passing around pulley wheels 140 and 142 pulls on housing plate 204. As housing plate 204 is pulled upward housing plate 204 pulls the attached sled 202 upward. Sled flanges 504 and 506 as a result of being seated in slots 206 and 207 respectively force platform 106 upward. The user returns the shoulders to the starting position and begins the movement again. The user's own weight provides the resistance for the movement.

To perform a biceps curl movement while simultaneously performing cardiovascular exercise, housing 130 is adjusted to be directly under grips 120 and 122 and cable 160 is attached to one of three cable hubs 216. Arm 116 is adjusted relative to disk 126 so that arm 116 is approximately waist level. The length of cable 160 is adjusted to remove any slack by loosening bolt 214, pulling cable 160 taut, and retightening bolt 214. The user sits on saddle 156 and places the feet on pedals 148 and 149. As the user begins pedaling, the user simultaneously uses the hands to grab the grips and while keeping the elbows in and bending only at the elbows, begins pulling up on the handlebars 117 and 118. The upward force on handlebars 117 and 118 causes arm 116 to raise which in turn causes disk 126 to rotate away from the user. Cable hub 216 pulls on cable 160 which after passing around pulley wheels 140 and 142 pulls on housing plate 204. As housing plate 204 is pulled upward housing plate 204 pulls the attached sled 202 upward. Sled flanges 504 and 506 as a result of being seated in slots 206 and 207 respectively force platform 106 upward. The user returns the hands to the starting position around waist level and begins the movement again. The user's own weight provides the resistance for the movement.

To perform a lat pulldown movement while simultaneously performing cardiovascular exercise, housing 130 is adjusted to be directly under grips 120 and 122 and cable 160 is attached to one of three cable hubs 217. Arm 116 is adjusted relative to disk 126 so that arm 116 and handlebars 117 and 118 are above the user's head and the user's arms are fully extended. The length of cable 160 is adjusted to remove any slack by loosening bolt 214, pulling cable 160 taut, and retightening bolt 214. The user sits on saddle 156 and places the feet on pedals 148 and 149. As the user begins pedaling, the user simultaneously uses the hands to grab grips 120 and 122 and pull down on handlebars 117 and 118. The downward force on handlebars 117 and 118 causes arm 116 to lower which in turn causes disk 126 to rotate towards the user. Cable hub 217 pulls up on cable 160 which after passing around pulley wheels 140 and 142 pulls up on housing plate 204. As housing plate 204 is pulled upward housing plate pulls the attached sled 202 upward. Sled flanges 504 and 506 as a result of being seated in slots 206 and 207 respectively force platform 106 upward. Platform 106 rotates about hinges 134 and 136 until the user brings the hands to chin level and stops pulling on handlebars 117 and 118. The user slowly returns the arms to the starting position and begins the movement again. The user's own weight provides the resistance for the movement.

To perform a dip movement while simultaneously performing cardiovascular exercise, housing 130 is adjusted to be directly under grips 120 and 122 and cable 160 is attached to one of three cable hubs 217. Arm 116 is adjusted relative to disk 126 so that handlebars 117 and 118 and arm 116 are approximately at the user's mid-torso level. The length of cable 160 is adjusted to remove any slack by loosening bolt 214, pulling cable 160 taut, and retightening bolt 214. The user sits on saddle 156 and places the feet on pedals 148 and 149. As the user begins pedaling, the user simultaneously uses the hands to grab grips 120 and 122 and push down on handlebars 117 and 118. The downward force on handlebars 117 and 118 causes arm 116 to lower which in turn causes disk 126 to rotate towards the user. Cable hub 217 pulls up on cable 160 which after passing around pulley wheels 140 and 142 pulls up on housing plate 204. As housing plate 204 is pulled upward housing plate pulls the attached sled 202 upward. Sled flanges 504 and 506 as a result of being seated in slots 206 and 207 respectively force platform 106 upward. Platform 106 rotates about hinges 134 and 136 until the user extend the arms fully and stops pushing on handlebars 117 and 118. The user slowly returns the arms to the starting position and begins the movement again. The user's own weight provides the resistance for the movement.

To perform a triceps extension movement while simultaneously performing cardiovascular exercise, housing 130 is adjusted to be directly under grips 120 and 122 and cable 160 is attached to one of three cable hubs 217. Arm 116 is adjusted relative to disk 126 so that handlebars 117 and 118 and arm 116 are approximately at the user's mid-torso level. The length of cable 160 is adjusted to remove any slack by loosening bolt 214, pulling cable 160 taut, and retightening bolt 214. The user sits on saddle 156 and places the feet on pedals 148 and 149. As the user begins pedaling, the user simultaneously uses the hands to grab the grips and while keeping the elbows in and bending only at the elbows, push down on handlebars 117 and 118. The downward force on handlebars 117 and 118 causes arm 116 to lower which in turn causes disk 126 to rotate towards the user. Cable hub 217 pulls up on cable 160 which after passing around pulley wheels 140 and 142 pulls up on housing plate 204. As housing plate 204 is pulled upward housing plate pulls the attached sled 202 upward. Sled flanges 504 and 506 as a result of being seated in slots 206 and 207 respectively force platform 106 upward. Platform 106 rotates about hinges 134 and 136 until the user extends the arms fully and stops pushing down on handlebars 117 and 118. The user slowly returns the arms to the starting position and begins the movement again. The user's own weight provides the resistance for the movement.

In an alternate embodiment, platform 106 may be fitted with additional weight in the form of typical circular plates on a post mounted to platform 106 or bars of weight on a rack mounted to platform 106. The additional weight can be added and removed according to user preference.

In an additional alternate embodiment, exercise apparatus 100 includes an electronic display that contains features such as built-in exercise programs with multiple levels of resistance. The monitor will include feedback on program level, duration, distance, RPM, speed, heart rate, calories burned and average speed.

Figure 9:
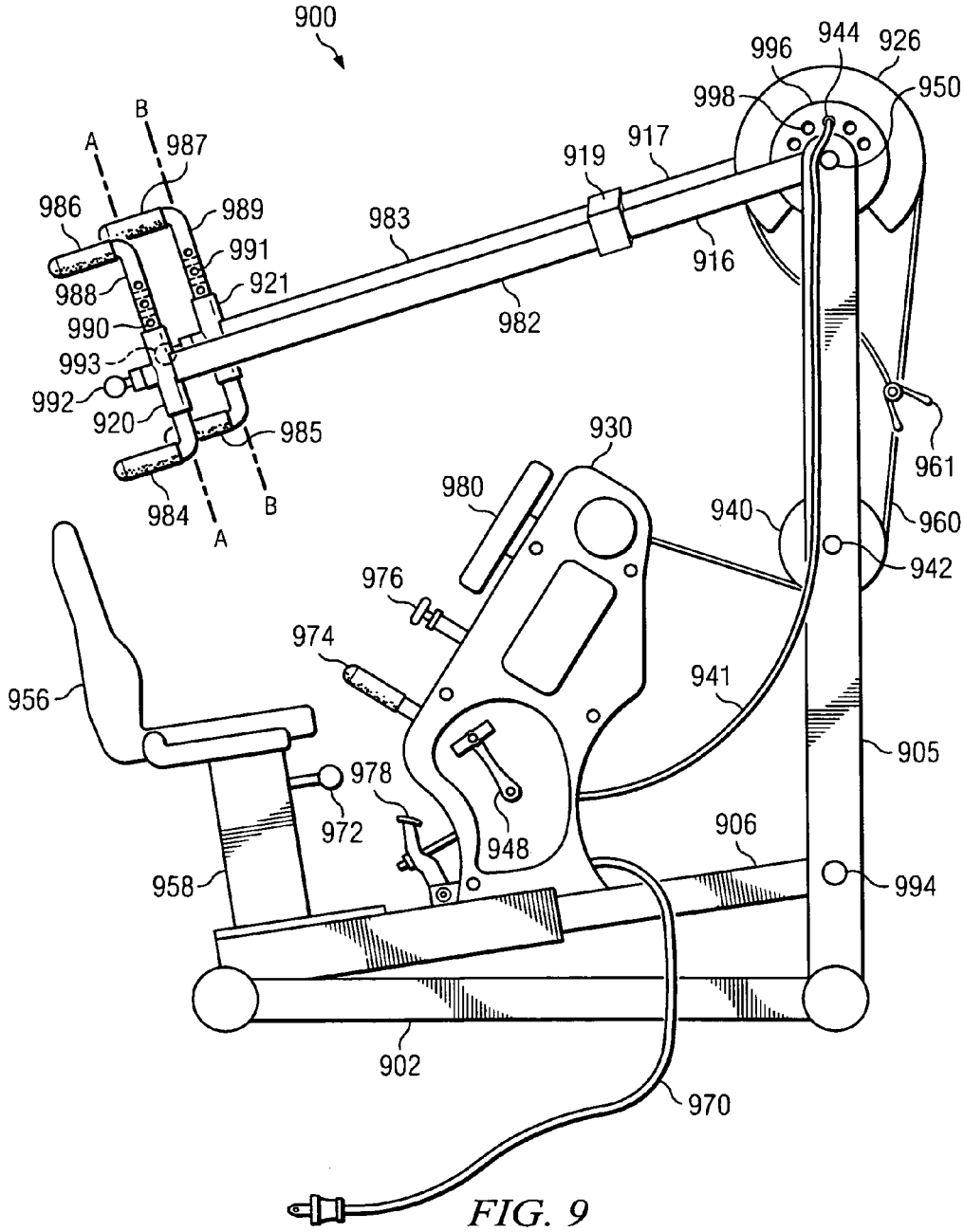
FIG. 9 is an elevation view of an alternate embodiment of the present invention
Figure 10:
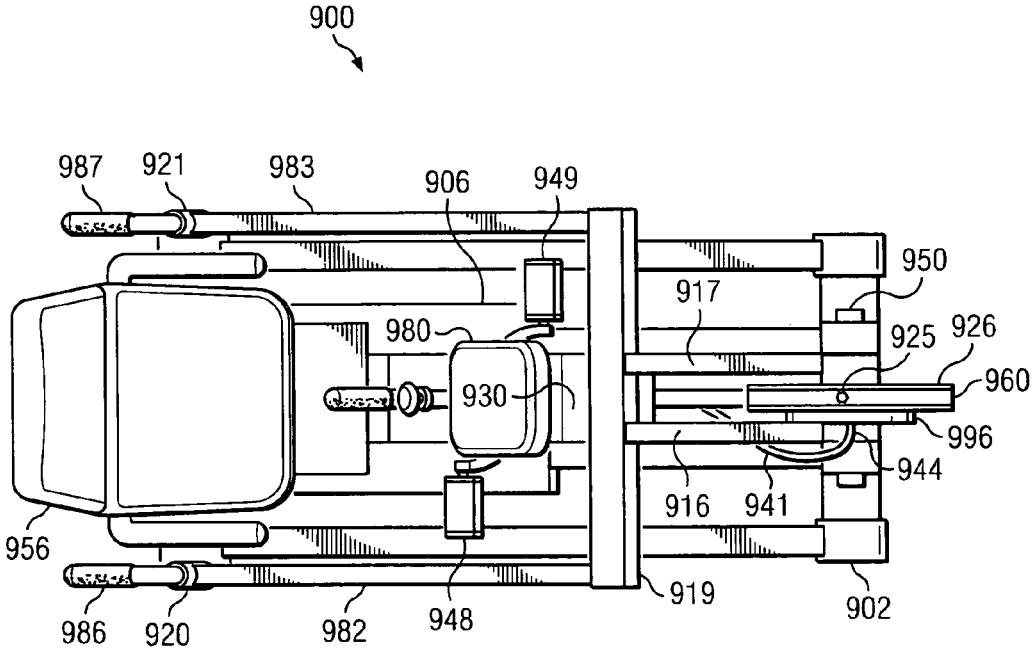
FIG. 10 is a plan view of an alternate embodiment of the present invention.

FIGS. 9 and 10 show an alternate embodiment, exercise apparatus 900. Base 902 is generally rectangular in shape and rigidly connected to a pair of uprights 905 and 906 at an angle in the range of 85 to 90 degrees. Platform 906 is rotationally connected to uprights 905 and 906 and pivots at one end around spindle 994 which extends perpendicularly between the two uprights. Extending from platform 906 is pedestal 958 which provides support and a mounting point for seat 956. Height adjustment knob 972 extends from pedestal 958 and is used to change the height of seat 956 in relation to platform 906. Housing 930 is supported by and is longitudinally adjustable with respect to platform 906. Pedals 948 and 949 extend from each lateral side of housing 930. Connected to the pedals in the interior of housing 930 is an adjustable resistance means as is common in the art for stationary exercise bicycles. Display 980 is mounted to housing 930. Display 980 is electronically connected to the resistance means and contains features such as built-in exercise programs with multiple levels of resistance. Display 980 can show feedback on program level, duration, distance, RPM, speed, heart rate, calories burned, and average speed. Power cord 970 extends from housing 930 and provides power to the resistance means and display 980. Also extending from housing 930 is tension knob 976, lever 974, and cable pedal 978. Tension knob 976 is connected to metal tape 960 and is an adjustment tool to keep metal tape 960 taut. Metal tape 960 could also be a wire cable. Lever 974 is used to adjust the longitudinal position of housing 930 along the length of platform 906. Cable pedal 978 is connected to wire 941. Wire 941 extends from pedal 978, through housing 930, along upright 905, and forms pin 944.

Pulley wheel 940 is mounted to the approximate vertical midpoint of uprights 905. Pulley wheel rotates about spindle 942 which extends perpendicularly between uprights 905. Metal tape 960 extends from housing 930, around pulley wheel 940, loops around disk 926 and is connected back upon itself at connector 961. Metal tape 960 is connected to the top of disk 926 by bolt 925. Disk 926 is a circular disk having a channel around its perimeter for guiding metal tape 960. Disk 926 rotates about spindle 950 which extends perpendicularly between and proximate the top of uprights 905. Plate 996 is a circular disk concentrically aligned with disk 926 and also rotates about spindle 950. Plate 996 includes a plurality of plate holes 998. Plate holes 998 are sized to accept pin 944. Disk 926 also includes a plurality of similarly sized holes (not shown) aligned with plate holes 998.

One end of each arm 916 and 917 is connected to the near midpoint of crossbar 919 at generally right angles. The opposite end of arm 917 is adjacent disk 926 and the opposite end of arm 916 is integrally formed with or welded to plate 996. Crossbar 919 joins arms 916 and 917 to handlebars 982 and 983. Handlebar 982 extends from one end of crossbar 919 generally forming a right angle. Handlebar 983 extends from the opposite end of crossbar 919 generally forming a right angle. Handlebars 982 and 983 are hollow cylindrical tubes having T-shaped junctions 920 and 921 respectively on each end. Each junction 920 and 921 further includes pin 992 and 993 respectively. Pins 992 and 993 can be spring loaded, or relay on gravity and friction to stay in place. Shaft 988 resides in junction 920 at the end of arm 982 and can rotate within junction 920 along axis A. Shaft 989 resides in junction 921 at the end of arm 983 and can rotate within junction 921 along axis B. Each shaft 988 and 989 has right angle bends on both ends forming grips. Shaft 988 includes grips 984 and 986. Shaft 989 includes grips 985 and 987. Shaft 988 further includes a plurality of adjustment holes 990. Adjustment holes 990 are equally spaced from each other, pass completely through shaft 988, and are sized to accept pin 992. Each adjustment hole 990 alternates its orientation through shaft 988 by 90 degrees resulting in each adjustment hole being perpendicular to its adjacent adjustment hole. Adjustment holes 991 are equally spaced from each other, pass completely through shaft 989, and are sized to accept pin 993. Each adjustment hole 991 alternates its orientation through shaft 989 by 90 degrees resulting in each adjustment hole being perpendicular to its adjacent adjustment hole.

To perform simultaneous exercises using exercise apparatus 900, a user must adjust the position of housing 930 relative to platform 906, adjust the position of arms 916 and 917 relative to disk 926, remove the slack out of metal tape 960, and adjust the position of the grips 984, 985, 986, and 987 relative to the handlebars.

To adjust the position of housing 930 relative to platform 906, lever 974 is used to disengage housing 930 from platform 906 and subsequently housing 930 moves longitudinally along platform 906. When housing 930 is in the desired position, lever 974 is used to reengage housing 930 with platform 906. To adjust the position of the arms relative to disk 926, cable pedal 978 is depressed thereby disengaging pin 944 from its position through plate 996 and disk 926. Once plate 996 is no longer locked to disk 926, arms 916 and 917 are free to rotate about spindle 950 to the desired position. Once the arms are in the desired position, cable pedal 978 is released and pin 944 is inserted through one of a plurality of plate holes 998 and into an aligned hole in disk 926. To remove the slack out of metal tape 960, tension knob 976 is rotated by hand until metal tape 960 is taut. To adjust the position of grips 984 and 986 relative to handlebar 982, pin 992 is pulled outward approximately 1 inch until the pin clears shaft 988. Once pin 992 clears shaft 988, shaft 988 is free to slide longitudinally through junction 920. With pin 992 disengaged, shaft 988 is also free to rotate about axis A resulting in grips 984 and 986 extending laterally inwardly or outwardly at a right angle from handlebar 982. Once the grips are in the desired position, pin 992 is released and reengaged with shaft 988 through an adjustment hole 990. Adjusting the position of grips 985 and 987 is accomplished in the same fashion using junction 921, pin 993, shaft 989, and adjustment holes 991.

To perform a shoulder press movement while simultaneously performing a cardiovascular exercise using exercise apparatus 900, housing 930 is adjusted to be a comfortable distance away from seat 956. A comfortable distance is when a user's extended leg still has a slight bend when the pedal is furthest away. Arms 916 and 917 are adjusted relative to disk 926 so that handlebars 982 and 983 are approximately shoulder level. Any slack in metal tape 960 is removed by rotating tension knob 976. The grips are adjusted to the desired position. The user sits on seat 956 and places the feet on pedals 948 and 949. As the user begins pedaling, the user simultaneously uses the hands to grab grips 984 and 985 or 986 and 987 and push up on handlebars 982 and 983. The different hand placements vary the difficulty of the movement. The upward force on handlebars 982 and 983 causes the arms to rise which in turn causes disk 926 to rotate away from the user. Metal tape 960 is secured to disk 926 and after passing around pulley wheel 940 pulls on housing 930. Platform 906 rotates about spindle 994 until the user fully extends the arms above the head and stops pushing on the handlebars. The user slowly returns the arms to the starting position and begins the movement again. The user's own weight provides the resistance for the movement.

To perform a shoulder shrug movement while simultaneously performing cardiovascular exercise using exercise apparatus 900, housing 930 is adjusted to be a comfortable distance away from seat 956. Arms 916 and 917 are adjusted relative to disk 926 so that handlebars 982 and 983 are approximately waist level. Any slack in metal tape 960 is removed by rotating tension knob 976. The grips are adjusted to the desired position. The user sits on seat 956 and places the feet on pedals 948 and 949. As the user begins pedaling, the user simultaneously uses the hands to grab grips 984 and 985 or 986 and 987 and raise the shoulders and the handlebars as high as possible while not bending the elbows. The upward force on handlebars 982 and 983 causes the arms to rise which in turn causes disk 926 to rotate away from the user. Metal tape 960 is connected to disk 926 and after passing around pulley wheel 940 pulls on housing 930. Platform 906 rotates about spindle 994 until the user fully completes the movement and stops pulling on the handlebars. The user returns the shoulders to the starting position and begins the movement again. The user's own weight provides the resistance for the movement.

To perform a biceps curl movement while simultaneously performing cardiovascular exercise using exercise apparatus 900, housing 930 is adjusted to be a comfortable distance away from seat 956. Arms 916 and 917 are adjusted relative to disk 926 so that handlebars 982 and 983 are approximately waist level. Any slack in metal tape 960 is removed by rotating tension knob 976. The grips are adjusted to the desired position. For a biceps curl, the grips should also be rotated inwardly or outwardly 90 degrees. The user sits on seat 956 and places the feet on pedals 948 and 949. As the user begins pedaling, the user simultaneously uses the hands to grab grips 984 and 985 or 986 and 987 and while keeping the elbows in and bending only at the elbows, begins pulling up on handlebars 982 and 983. The upward force on the handlebars causes the arms to rise which in turn causes disk 926 to rotate away from the user. Metal tape 960 is connected to disk 926 and after passing around pulley wheel 940 pulls on housing 930. Platform 906 rotates about spindle 994 until the user brings the hands to the chest. The user returns the hands to the starting position around waist level and begins the movement again. The user's own weight provides the resistance for the movement.

To perform a lat pulldown movement while simultaneously performing cardiovascular exercise using exercise apparatus 900, housing 930 is adjusted to be a comfortable distance away from seat 956. Arms 916 and 917 are adjusted relative to disk 926 so that handlebars 982 and 983 are above the user's head and the user's arms are fully extended. Any slack in metal tape 960 is removed by rotating tension knob 976. The grips are adjusted to the desired position. The user sits on seat 956 and places the feet on pedals 948 and 949. As the user begins pedaling, the user simultaneously uses the hands to grab grips 984 and 985 or 986 and 987 and pull down on handlebars 982 and 983. The downward force on the handlebars causes the arms to lower which in turn causes disk 926 to rotate towards the user. Metal tape 960 is connected to disk 926 and after passing around pulley wheel 940 pulls on housing 930. Platform 906 rotates about spindle 994 until the user brings the hands to chin level and stops pulling on the handlebars. The user slowly returns the arms to the starting position and begins the movement again. The user's own weight provides the resistance for the movement.

To perform a dip movement while simultaneously performing cardiovascular exercise using exercise apparatus 900, housing 930 is adjusted to be a comfortable distance away from seat 956. Arms 916 and 917 are adjusted relative to disk 926 so that handlebars 982 and 983 are approximately at the user's mid-torso level. Any slack in metal tape 960 is removed by rotating tension knob 976. The grips are adjusted to the desired position. The user sits on seat 956 and places the feet on pedals 948 and 949. As the user begins pedaling, the user simultaneously uses the hands to grab grips 984 and 985 or 986 and 987 and push down on handlebars 982 and 983. The downward force on the handlebars causes the arms 916 and 917 to lower which in turn causes disk 926 to rotate towards the user. Metal tape 960 is connected to disk 926 and after passing around pulley wheel 940 pulls on housing 930. Platform 906 rotates about spindle 994 until the user extends the arms fully and stops pushing on the handlebars. The user slowly returns the arms to the starting position and begins the movement again. The user's own weight provides the resistance for the movement.

To perform a triceps extension movement while simultaneously performing cardiovascular exercise using exercise apparatus 900, housing 930 is adjusted to be a comfortable distance away from seat 956. Arms 916 and 917 are adjusted relative to disk 926 so that handlebars 982 and 983 are approximately at the user's mid-torso level. Any slack in metal tape 960 is removed by rotating tension knob 976. The grips are adjusted to the desired position. The user sits on seat 956 and places the feet on pedals 948 and 949. As the user begins pedaling, the user simultaneously uses the hands to grab grips 984 and 985 or 986 and 987 and while keeping the elbows in and bending only at the elbows, begins pushing down on the handlebars. The downward force on handlebars 982 and 983 causes the arms to lower which in turn causes disk 926 to rotate towards the user. Metal tape 960 is connected to disk 926 and after passing around pulley wheel 940 pulls on housing 930. Platform 906 rotates about spindle 994 until the user extends the arms fully and stops pushing down on handlebars 982 and 983. The user slowly returns the arms to the starting position and begins the movement again. The user's own weight provides the resistance for the movement.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. An exercise machine providing cardiovascular exercise simultaneously with weight training movements comprising:

a four piece rectangular shaped base frame having a first vertical support member and a second vertical support member, each extending upwardly from the base parallel to each other;

a first crossmember, having a first axle supporting a first wheel and a second axle supporting a second wheel, connected between the first vertical support member and the second vertical support member;

a disk having a first lateral surface and a second lateral surface and defining a center hole, the first lateral surface having a plurality of aligned protrusions and a plurality of holes;

a first hollow cylinder integrally formed with and extending perpendicular from the first lateral surface and concentrically aligned with the center hole;

a second hollow cylinder integrally formed with and extending perpendicular from the second lateral surface and concentrically aligned with the center hole;

a second crossmember connected between the first vertical support and the second vertical support and providing a rotational axis for the first hollow cylinder, the disk and the second hollow cylinder;

an arm having a set of handlebars and rotationally connected to the second hollow cylinder, the arm adjacent the second lateral surface and adjustably connected to the second lateral surface by a first retractable pin;

a four piece rectangular platform pivotally connected to the first vertical support member and pivotally connected to the second vertical support member, the platform having a first major side and a second major side parallel to the first major side, the first major side having a first slot and the second major side having a second slot;

a housing, having a seat and rotatable pedals, slidably connected to the platform, the housing secured in position by a second retractable pin;

a cable having one end adjustably secured to the housing and an opposite end removably secured to one of the plurality of aligned protrusions, the cable passing between the first wheel and the second wheel such that upward force on the handlebars causes the arm to raise which in turn causes the disk to rotate thereby causing the cable to lift the housing and the platform together to rotate about the first and second vertical support members so that resistance for the weight training movements is provided by a user's body weight.

2. The exercise machine of claim 1 where the platform includes mounting points for additional weight.

3. The exercise machine of claim 1 where the cable is removably secured to the disk by a spring collar.

4. The exercise machine of claim 1 where the first retractable pin and the second retractable pin are held engaged by a spring.

5. The exercise machine of claim 1 where the first retractable pin and the second retractable pin are held engaged by gravity and friction.

6. A method for a user having hands, feet, and a body weight to perform a weight training exercise simultaneously with a cardiovascular exercise comprising the steps of:

providing a four piece rectangular shaped base frame connected to a first vertical support member and a second vertical support member;

providing a first crossmember, having a first axle supporting a first wheel and a second axle supporting a second wheel, connected between the first vertical support member and the second vertical support member;

providing a disk having a first lateral surface and a second lateral surface and defining a center hole, the first lateral surface having a plurality of aligned protrusions and a plurality of holes;

providing a first hollow cylinder integrally formed with and extending perpendicular from the first lateral surface and concentrically aligned with the center hole;

providing a second hollow cylinder integrally formed with and extending perpendicular from the second lateral surface and concentrically aligned with the center hole;

providing a second crossmember, connected between the first vertical support and the second vertical support, that provides a rotational axis for the first hollow cylinder, the disk and the second hollow cylinder;

providing an arm having a set of handlebars and rotationally connected to the second hollow cylinder, the arm adjacent the second lateral surface and adjustably connected to the second lateral surface by a first retractable pin;

providing a four piece rectangular platform pivotally connected to the first vertical support member and pivotally connected to the second vertical support member, the platform having a first major side and a second major side parallel to the first major side, the first major side having a first slot and the second major side having a second slot;

providing a housing having a seat and a pair of pedals slidably connected to the platform, the housing secured in position by a second retractable pin; and providing a cable adjustably secured to the housing by a bolt and removably secured to one of the plurality of aligned protrusions, the cable passing between the first wheel and the second wheel;

adjusting the housing relative to the platform by raising the second retractable pin, sliding the housing longitudinally relative to the platform into a first desired position and lowering the second retractable pin into place;

adjusting the arm relative to the disk by removing the first retractable pin, rotating the arm relative to the disk into a second desired position and inserting the first retractable pin into place;

adjusting an attachment point of the cable relative to the disk by removing the cable from one of the plurality of aligned protrusions and securing it to another one of the plurality of aligned protrusions;

adjusting the cable by loosening the bolt, removing any slack in the cable, and retightening the bolt;

sitting on the seat, placing the feet on the pair of pedals and performing a cardiovascular exercise by pedaling the pair of pedals; and grabbing the set of handlebars with the hands, applying a force to the set of handlebars and performing a weight training exercise simultaneously with a cardiovascular exercise, where a resistance for the weight training exercise is provided by the body weight.

7. The method of claim 6 where the step of grabbing the set of handlebars includes pushing up on the set of handlebars to perform a shoulder press simultaneously with a cardiovascular exercise, wherein the second desired position is approximately shoulder level of a user sitting on the seat.

8. The method of claim 6 where the step of grabbing the set of handlebars includes pushing down on the set of handlebars to perform a dip simultaneously with a cardiovascular exercise, wherein the second desired position is approximately mid-torso level of a user sitting on the seat.

9. The method of claim 6 where the step of grabbing the set of handlebars includes raising up the set of handlebars to perform a shoulder shrug simultaneously with a cardiovascular exercise, wherein the second desired position is approximately waist level of a user sitting on the seat.

10. The method of claim 6 where the step of grabbing the set of handlebars includes pulling down on the set of handlebars to perform a lat pulldown simultaneously with a cardiovascular exercise, wherein the second desired position is approximately overhead of a user sitting on the seat.

11. The method of claim 6 where the step of grabbing the set of handlebars includes pulling up on the set of handlebars to perform a biceps curl simultaneously with a cardiovascular exercise, wherein the second desired position is approximately waist level of a user sitting on the seat.

12. The method of claim 6 where the step of grabbing the set of handlebars includes pushing down on the set of handlebars to perform a triceps extension simultaneously with a cardiovascular exercise, wherein the second desired position is approximately mid-torso level of a user sitting on the seat.

13. The method of claim 6 further comprising the step of adding additional weight to the platform.

* * * * *